US005398407A

United States Patent [19]

Stuer

[11] Patent Number: 5,398,407

[45] Date of Patent: Mar. 21, 1995

[54] METHOD FOR PRODUCING A DEVICE FOR MUFFLING SOUND OR CATALYTIC TREATMENT OF EXHAUST

[75] Inventor: William D. M. Stuer, Knokke-Heist, Belgium

[73] Assignee: Scambia Industrial Developments Aktiengesellschaft, Schaan, Liechtenstein

[21] Appl. No.: 138,550

[22] Filed: Oct. 15, 1993

Related U.S. Application Data

[63] Continuation-in-part of Ser. No. 907,898, Jul. 2, 1992, abandoned.

[30] Foreign Application Priority Data

Jul. 8, 1991 [CH] Switzerland ..... 2015/91

[51] Int. Cl.[6] ..... B23P 15/00

[52] U.S. Cl. ..... 29/890; 29/890.08

[58] Field of Search ..... 29/890, 890.08, 505–513, 29/455.1; 181/61; 72/61, 368

[56] References Cited

U.S. PATENT DOCUMENTS

| | | | |
|---|---|---|---|
| 2,761,525 | 9/1956 | Moss . | |
| 3,209,787 | 10/1965 | Brown et al. . | |
| 3,242,558 | 3/1966 | Selig | 29/890.08 |
| 3,276,540 | 10/1966 | Crouse | 29/890.08 |
| 3,945,460 | 3/1976 | McMillan . | |
| 5,170,557 | 12/1992 | Rigsby | 29/890.08 |

FOREIGN PATENT DOCUMENTS

| | | | |
|---|---|---|---|
| 0047525 | 3/1982 | European Pat. Off. . | |
| 0431649 | 6/1991 | European Pat. Off. . | |
| 3920600 | 1/1991 | Germany . | |
| 62-96720 | 5/1987 | Japan . | |
| 3081136 | 4/1991 | Japan | 29/890.08 |
| 2225620 | 6/1990 | United Kingdom | 29/890.08 |

*Primary Examiner*—Irene Cuda
*Attorney, Agent, or Firm*—Anderson Kill Olick & Oshinsky

[57] ABSTRACT

The invention is directed to a method for producing a device forming a muffler 1 or a catalytic converter comprising a casing having an outer wall part 4 and an inner wall part 5. The two wall parts 4, 5 are connected with one another at least at the ends of the casing and are constructed in such a way that there is an intermediate space 16 between them at least in some places. This intermediate space 16 is produced in that a pressure is generated between the inner wall part 5 and the outer wall part 4 by a substance in order to bend one wall part 4, 5 away from the other wall part 4, 5 at least in some places.

14 Claims, 3 Drawing Sheets

METHOD FOR PRODUCING A DEVICE FOR MUFFLING SOUND OR CATALYTIC TREATMENT OF EXHAUST

This is a continuation-in-part application of Ser. No. 07/907,898, filed Jul. 2,1992.

The invention is directed to a method for producing a device for muffling sound or for the catalytic treatment of exhaust.

BACKGROUND OF THE INVENTION

A known muffler provided for installation in the exhaust line of an internal combustion engine has an elongated doublewalled casing which is generally cylindrical and circular in cross section, its two wall parts contacting one another so as to be approximately free of play. The pulsating flows of gas contained in the exhaust flow are smoothed in the muffler so that the intake and exhaust noises of the internal combustion engine are deadened. This is achieved in that the exhaust flow is guided through at least one chamber and/or at least one perforated exhaust pipe enveloped by a sound absorbing material. In the method for producing such a muffler, two sheet metal pieces having a thickness of 0.5 mm are placed one upon the other and bent toward the longitudinal wall. During or after the bending, at least one exhaust pipe and the sound absorbing material are inserted into the casing. Following this, the edges of the two wall parts extending along a generating or surface line are turned up to form a longitudinal flange and are connected with one another at their ends and with a closing wall in each instance.

Since the two snugly contacting metallic wall parts have a relatively high sound and heat conductivity, this muffler has poor sound and heat insulation.

A second known muffler which differs only slightly from the muffler described above and is manufactured according to the same method comprises an intermediate space between the two wall parts. The wall parts are held at a distance from one another by a fiberglass layer located between them. The radial distance between the outer surface of the inner wall part and the inner surface of the outer wall part is normally approximately 1 mm to 2 mm.

The fiberglass layer improves the sound and heat insulation of the muffler. But this improvement is only slight, since the fiberglass layer used for improving the insulation is very thin and has a relatively high thermal conductivity. In addition to this, the fiberglass layer is relatively expensive.

Similar problems are also posed in the production of catalytic converters.

The object of the present invention is to develop a method by which a device forming a muffler or catalytic converter can be produced without the disadvantages of the described mufflers.

SUMMARY OF THE INVENTION

These and other objects of the invention, which shall become hereafter apparent, are achieved by the present Method For Producing a Device For Muffling Sound or Catalytic Treatment of Exhaust and having a casing, an outer wall part and an inner wall part, and two ends, wherein the wall parts are at a distance from one another at least in some place, and wherein the method comprises the steps of reconnecting the two wall parts to each other, at least at the two ends of the casing, generating a pressure between the outer wall part and the inner wall part by a substance in order to bend the inner wall part away from the outer wall part at least in some places, and indenting the inner wall part in the interior of the casing.

The device comprises an elongated casing having an outer wall part and an inner wall part. The two wall parts are connected to one another at both ends of the casing, each wall part being connected in every instance with a terminating or closing wall. The method can be used for e.g., producing a device for forming a muffler or catalytic converter which serves as part of an exhaust system of an internal combination engine and is connected with the exhaust outlet of such an engine.

BRIEF DESCRIPTION OF THE DRAWINGS

The subject matter of the invention is now explained with reference to three embodiment examples shown in the drawing.

DETAIL DESCRIPTION OF THE PREFERRED EMBODIMENT

Figure 1:
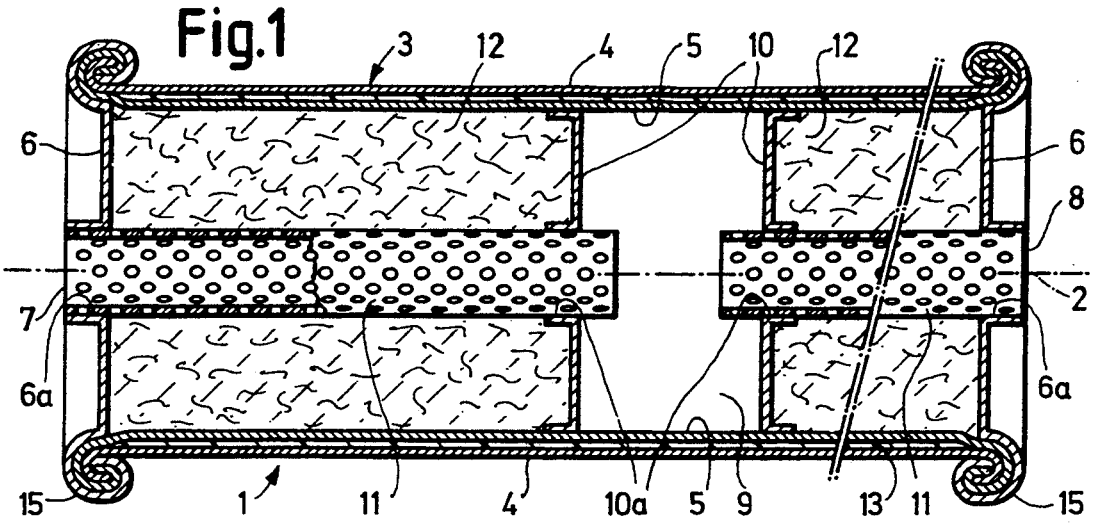
FIG. 1 shows a longitudinal section through a muffler having an outer wall part and an inner wall part prior to the indentation of the latter.
Figure 2:
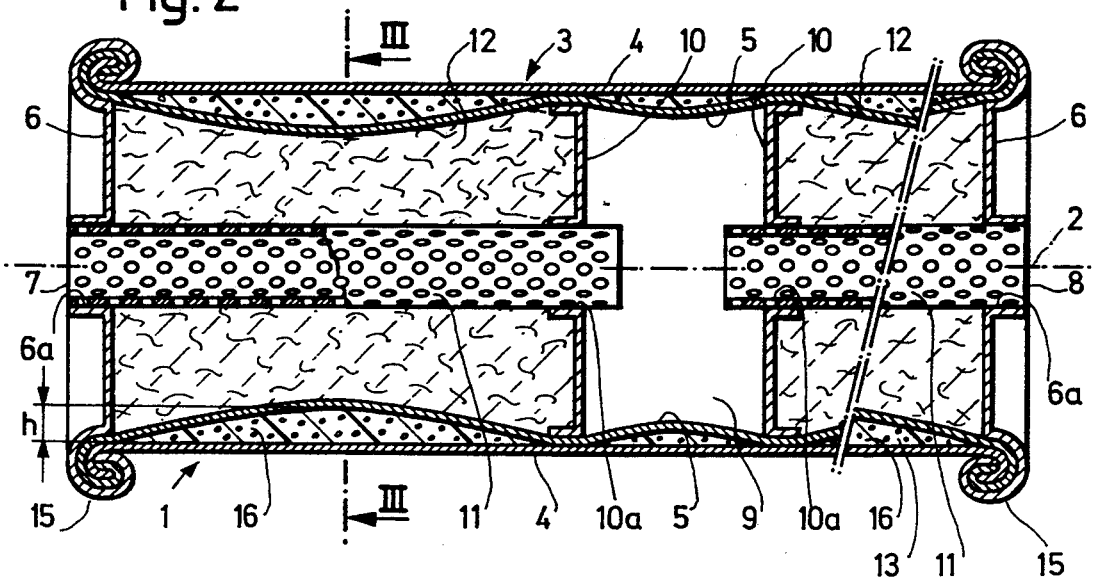
FIG. 2 shows a longitudinal section through the muffler shown in FIG. 1, but with an inner wall part which is indented in some places.
Figure 3:
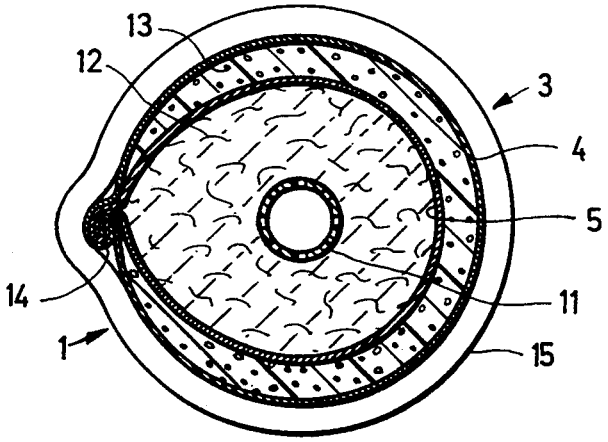
FIG. 3 shows a section through the muffler according to line III—III of FIG. 2.

The device shown in FIGS. 1 to 3 forms a muffler 1 and comprises a casing with a horizontal axis 2. The muffler 1 is provided for installation in the exhaust system of an internal combustion engine and can be connected, e.g. directly or via a catalytic converter, with the exhaust outlet of an internal combustion engine. The casing of the muffler 1 has walls comprising an elongated, sleeve-like longitudinal wall 3 which is generally cylindrical and more or less circular in cross section and has an outer wall part 4 as well as an inner wall part 5. The walls are further made up of two closing walls 6 arranged at the two ends of the longitudinal wall 3. One closing wall comprises an exhaust inlet 7 feeding in the exhaust and the other closing wall comprises an exhaust outlet 8 serving to guide away the exhaust.

The interior 9 of the muffler 1 is divided into three regions by two intermediate walls 10. The middle interior region which is constructed as a hollow chamber is connected with the inlet 7 and the outlet 8 via perforated exhaust pipes 11. Each of the two exhaust pipes 11 penetrates an intermediate wall 10 and a closing wall 6 and is enveloped in the two outer regions of the interior 9 by a sound absorbing material 12 which comprises e.g. rock wool and/or basalt wool. The two wall parts 4 and 5 of the muffler 1 are securely connected with one another along a surface line by a longitudinal flange 14 and are likewise securely connected with one another at their ends as well as with the closing walls 6 by means of an end flange 15.

It is noted here that the walls in FIGS. 1 to 3, as well as in the other described figures, are drawn with overproportionate thickness for reasons relating to graphic depiction.

In producing the muffler 1 shown in FIG. 1, two planar sheet metal pieces are first cut to the desired dimensions of the longitudinal wall 3. These sheet metal pieces which serve to form the two wall parts 4 and 5 have a thickness between 0.5 mm and 1.5 mm. Two sheet metal pieces of identical thickness are preferably used to produce a muffler 1. However, it is also possible that the sheet metal piece serving to form the inner wall part 5 can be somewhat thinner than the sheet metal piece serving to form the outer wall part 4.

In the next method step, an expanding agent 13 in a more or less free-flowing or at least pasty state is applied to the outer surface of the sheet metal piece forming the inner wall part 5 and/or to the inner surface of the sheet metal piece forming the outer wall part 4. This can be effected e.g. by spraying or brushing on. It is preferable that no expanding agent 13 be applied to the edge zones of the sheet metal pieces serving to produce the longitudinal flange 14 and end flange 15. The expanding agent 13 can be made up, for example, of a dispersion with a dispersion medium and a plastic-containing material, available under the name of "Mikroperlen" from the firm LEHMANN & FOSS & CO., Hamburg, Germany, which is dispersed in the latter and expands when heated and in so doing increases by 40 to 70 times its volume. The expanding agent contains 5 percent by weight to 20 percent by weight of the dispersed material and is applied in a coating thickness of at least 0.1 mm.

The two sheet metal pieces are then placed one upon the other and bent toward the longitudinal wall 3. The intermediate walls 10, exhaust pipes 11 and sound absorbing material 12 are inserted during or after bending. The intermediate walls 10 are constructed as disks or plates and comprise an outer angled edge region and an angled edge region at the holes 10*a*. These edge regions contact the inner wall part 5 and the exhaust pipes 11 and can form a pressure connection with the latter and/or be spot welded for example. The ends of the two wall parts 4 and 5 extending along a surface line are then pressed together and turned up to form a longitudinal flange 14, shown in a simplified manner in FIG. 3, and possibly also spot welded together. In so doing, the two wall parts 4 and 5 contact one another via the expanding agent 13 located between them preferably with, at most, slight play and, if possible, none at all and so as to fit snugly. Finally, the closing walls 6 are placed on the exhaust pipes 11 which partially project out. The closing walls 6, like the intermediate walls 10, are constructed as plates and have an outer angled edge region and an angled edge region at the holes 6*a*. The outer edge region is then folded with the wall parts 4 and 5 to form an end flange 15 and pressed together with the latter and possibly spot welded in addition. The closing walls 6 and the intermediate walls 10 comprise metal pieces which preferably have a thickness of 1.5 to 2.5 mm.

After the two wall parts 4 and 5 are connected with one another and with the closing walls 6 as well as with the intermediate walls 10, the expanding agent 13 is heated to a temperature of at least 80° C., preferably at least 100° C., e.g. 120° C. to 140° C. The expanding agent 13 accordingly foams and expands. In so doing, it generates a pressure which causes an indentation of the inner wall part 5 in some places so that the latter assumes the approximate shape shown in FIGS. 2 and 3. That is, an intermediate space 16 is formed between the wall parts 4 and 5 in every region between two adjacent walls 6 and 10 and 10 and 10, respectively, wherein the inner wall part 5 still contacts the outer wall part 4 at the closing walls 6, intermediate walls 10 and longitudinal flange 14. The greatest radial distance h between the outer surface of the inner wall part 5 and the inner surface of the outer wall part 4 is at least 3 mm, e.g. 6 mm. The intermediate spaces 16 are first filled by foamed expanding agent 13. After the indentation of the inner wall part 5, the muffler 1 can now be heated to a temperature of at least 300° C., e.g. 400° C. The expanding agent 13 is at least partially burnt by this additional heating. After the burning of the expanding agent 13, the intermediate spaces 16 contain, at most, small quantities of the ashes caused by the burning, i.e. they no longer contain practically any solid material.

The heating of the muffler serving to indent the inner wall part 5, particularly the heating of the expanding agent 13 located between its wall parts 4 and 5, is effected e.g. in a workshop of the production plant. However, it is also possible to install the muffler in the exhaust system of an internal combustion engine in the state shown in FIG. 1—that is, with an inner wall part 5 which is not indented. The indentation of the inner wall part 5 and the burning of the expanding agent 13 will then be triggered by the hot exhaust.

Figure 4:
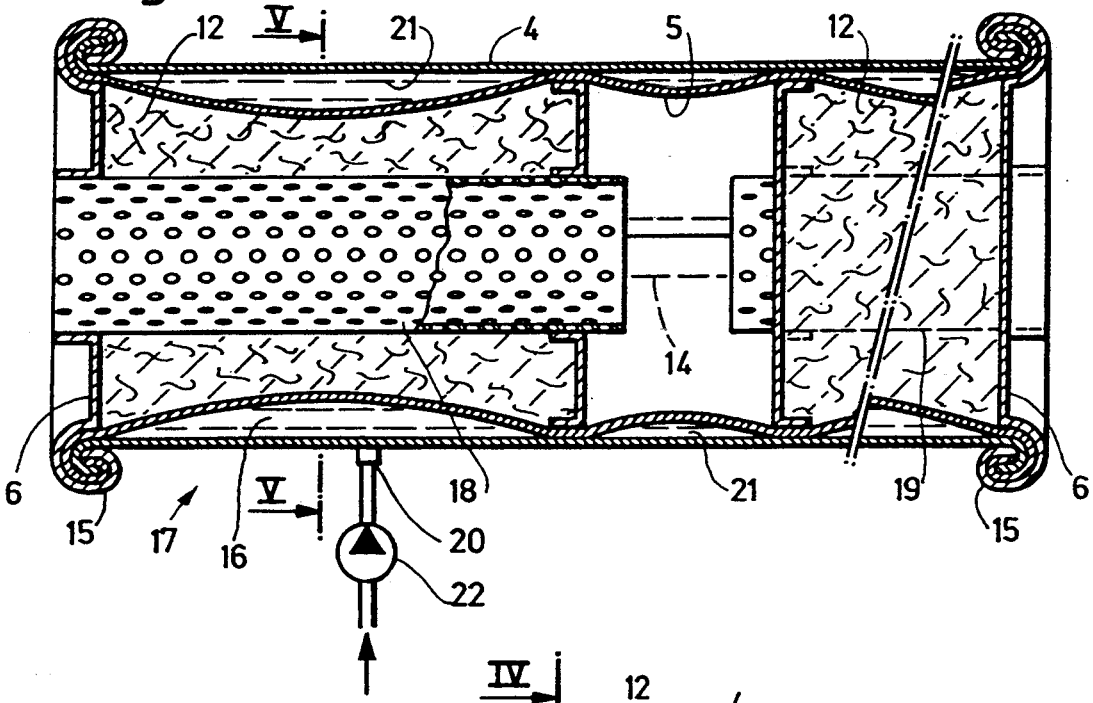
FIG. 4 shows a longitudinal section through another muffler according to line IV—IV of FIG. 5.
Figure 5:
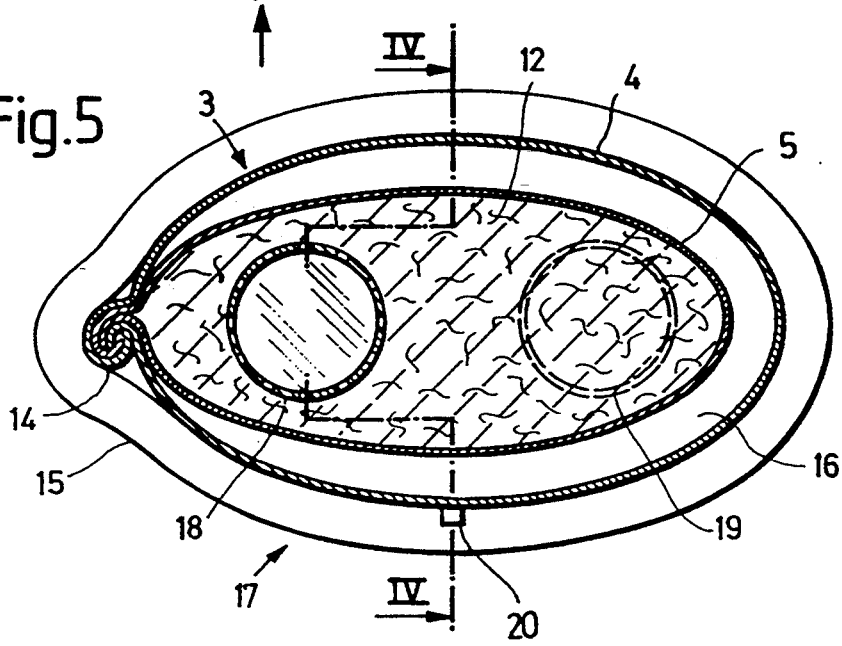
FIG. 5 shows a section according to line V—V of the muffler shown in FIG. 4.

The construction of the muffler shown in FIGS. 4 and 5 and designated in its entirety by 17 is similar, in part, to that of the muffler 1 described with reference to FIGS. 1 to 3. The casing of the muffler 17 comprises two wall parts, likewise designated by 4 and 5. However, the muffler 17 is oval in cross section and has oval closing and intermediate walls, likewise designated by 6 and 10, respectively. Its two perforated exhaust pipes, designated by 18 and 19, are offset relative to one another in cross section. Further, a connection piece 20 which opens between the two wall parts 4 and 5 is inserted in the outer wall part 4.

The production of the muffler 17 is effected in a manner partly similar to that of the production of the muffler 1 shown in FIG. 1. However, a substantial difference is to be noted in that no expanding agent is applied between the two wall parts 4 and 5.

In this case, a fluid, namely water 21, is injected through the connection piece 20 between the two wall parts 4 and 5 of the longitudinal wall by means of a pump 22 to form the intermediate spaces 16 of the muffler 17. The inner wall part 5 is then indented in the region between every two adjacent walls 6 and 10 and 10 and 10, respectively, by the generated pressure. The fluid pressure required for this is dependent on the cross-sectional dimensioning of the wall parts 4 and 5 and on their thickness and can be e.g. 10 to 50 MPa. After the indentation of the inner wall part 5 and the removal of the pump 22, the water 21 can escape via the connection piece 20 and/or possibly the longitudinal flange 14 and end flange 15 so that the muffler 17 comprises intermediate spaces 16, as shown in FIG. 5, which no longer contain water 21.

Of course, a gas, e.g. air, can also be used instead of water 21 as fluid for indenting the inner wall part 5.

Figure 6:
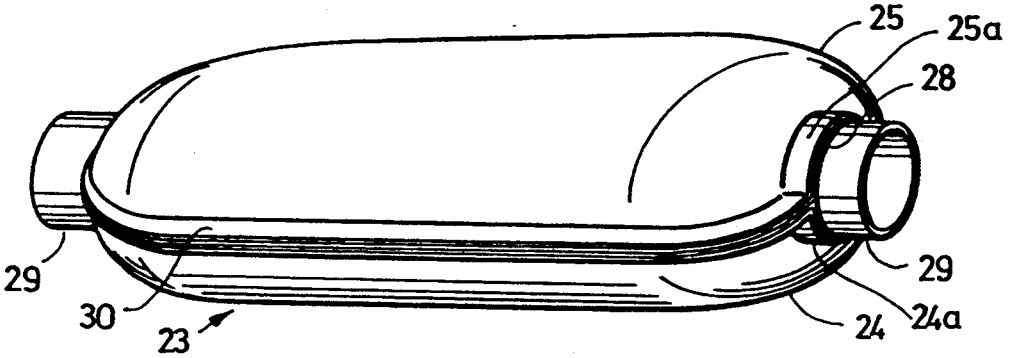
FIG. 6 shows a plan view of another muffler whose casing comprises half-shells.
Figure 7:
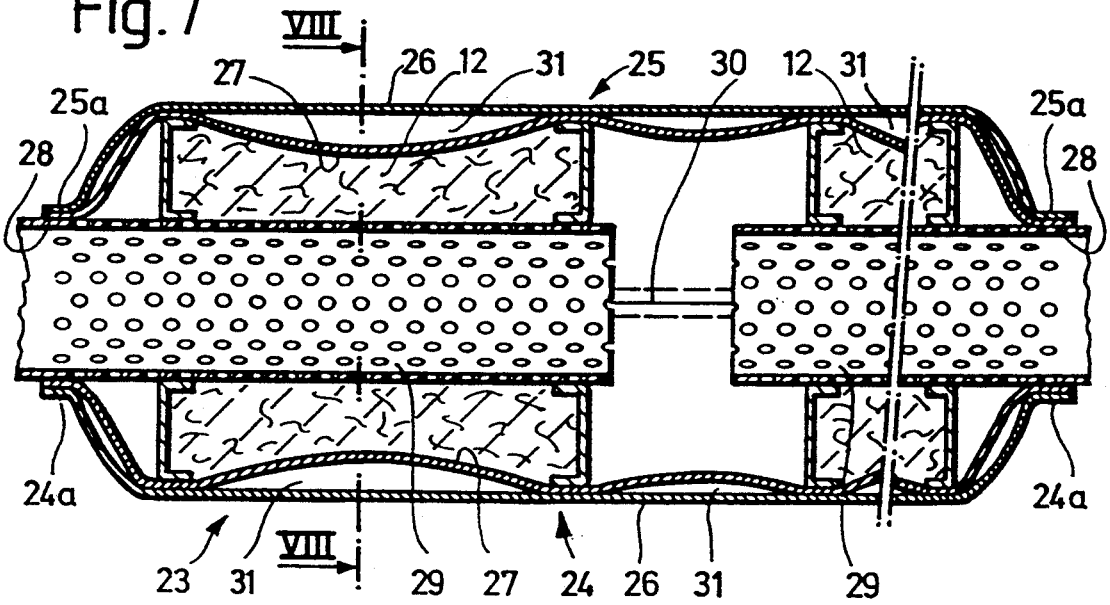
FIG. 7 shows a longitudinal section through the muffler shown in FIG. 6 according to line VII—VII of FIG. 8.
Figure 8:
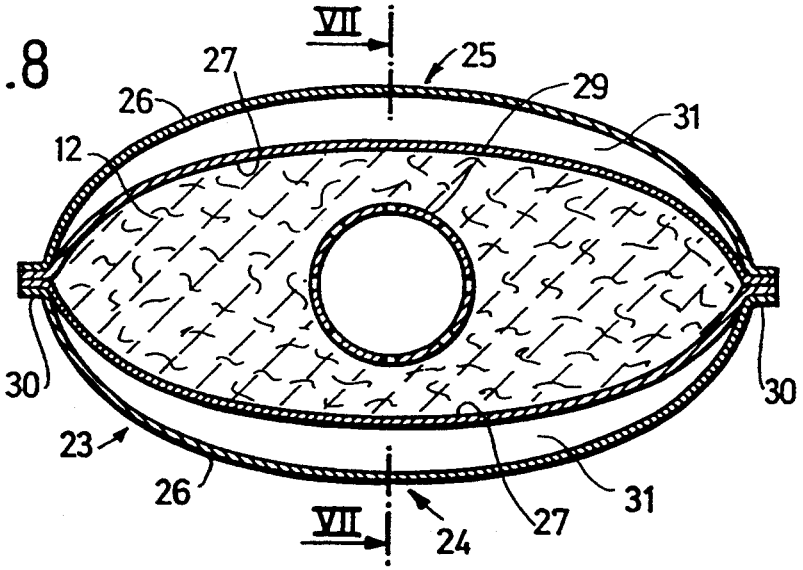
FIG. 8 shows a section according to line VIII—VIII of the muffler shown in FIG. 7.

The muffler shown in FIGS. 6, 7 and 8 and designated in its entirety by 23 likewise has an elongated form and comprises a casing which is formed by two identical shells, namely a first, lower shell 24 and a second, upper shell 25, each of which has an outer wall part 26 and an inner wall part 27. The shells 24 and 25 comprise two semicircular, outwardly projecting portions 24*a* and 25*a* at their ends. These portions 24*a* and 25*a*, respectively, form a collar-shaped and a circular opening 28 in pairs. The shells 24 and 25 and their wall parts 26 and 27 additionally comprise edge portions 30 at their elongated edge regions, which edge portions 30 likewise project out, contact one another and are welded together.

The interior of the casing is constructed so as to be exactly identical to the interior of the muffler 1 shown in FIGS. 1 and 3 and comprises two exhaust pipes 29 which penetrate the circular openings 28 and are possibly welded with the outwardly projecting portions 24*a*, 25*a* of the casing.

The intermediate spaces 31 in the walls of the muffler 23 can be produced either according to the method described with reference to FIGS. 1 to 3 or the method described with reference to FIGS. 4 and 5.

The method for producing a muffler shown in FIGS. 1 to 7 can be changed in various ways. It is noted first that the wall parts or walls of the muffler, those which are visible as well as those which are not visible, comprise stainless steel and can possibly be provided with a thin aluminum coat.

Further, it should be noted that the magnitude and the number of chambers and also the lengths and opening cross sections of the exhaust pipes can be selected as desired so that it is possible to produce mufflers of the described type which can be optimally adapted to the intended use, i.e. to the stroke volume of the corresponding internal combustion engine.

If a device serving as a catalytic converter is to be produced, this device can comprise casings similar to those described in the preceding with reference to FIGS. 1 to 8. For a device serving as a catalytic converter, a casing of the type shown in FIGS. 6 to 8 comprising two half-shells is particularly advisable. Together, the two half-shells can form a substantially cylindrical outer surface area which is circular, oval or elliptical in cross section. Then, instead of the exhaust pipes 11, 18 and 29 and instead of the sound absorbing material 12, the casing can contain at least one catalytic converter body comprising passages whose defining surfaces are coated with a catalytically active material.

While the preferred embodiments of the invention have been described in detail, modifications and adaptations may be made thereto without departing from the spirit an scope of the invention as delineated in the following claims.

What is claimed is:

1. A method of manufacturing an apparatus for muffling sound or catalytic treatment of exhaust and including a casing having an elongate longitudinal wall formed of an outer wall part and an imperforated inner wall part, and two opposite closing walls, said method comprising the steps of:

placing two sheet metal pieces for forming the outer and inner wall parts, respectively, one upon another;

bending the two sheet metal pieces to form the longitudinal wall, said bending step including the step of pressing longitudinal end portions of the two wall parts extending along a surface line together and turning them up to form a longitudinal flange;

connecting the two wall parts, at opposite axial ends of the casing, to each other and to respective closing walls, and thereafter, generating a pressure between the outer and inner wall parts by a substance for indenting the inner wall part, at least in some places, toward an interior of the casing thereby to produce an intermediate space between the two wall parts.

2. The method of claim 1, wherein the substance is an expanding agent provided between the two sheet metal pieces before said bending step, and further wherein said pressure generating step comprises the step of heating the expanding agent for expanding the same.

3. The method of claim 2, wherein said heating step includes connecting the apparatus to an exhaust outlet of an internal combustion engine and heating the expanding agent with exhaust gases of the internal combustion engine.

4. The method of claim 2, comprising the steps of providing a foamable expanding agent, and burning the foamable expanding agent, after indenting of the inner wall part has been completed, at a heating temperature of at least 300° C.

5. The method of claim 1, wherein said substance is a fluid, and wherein said pressure generating step includes injecting the fluid between the inner and outer part.

6. The method of claim 5, wherein the fluid is one of liquid and gas.

7. A method of manufacturing an apparatus for muffling sound or catalytic treatment of exhaust and including a casing formed of two substantially identical metallic shells each of which consists of an outer wall part and an imperforated inner wall part, with both wall parts having a curved section and flanges projecting outwardly from the curved section, said method comprising the steps of:

forming each of the two shells by connecting the outer and inner wall parts with each other at their flanges;

connecting the two shells with each other at least at the flanges of respective inner wall parts; and thereafter, generating a pressure between the outer and inner wall parts of each shell by a substance for indenting the inner wall part, at least in some places, toward an interior of the casing thereby to produce an interior space between the two wall parts.

8. The method of claim 7, wherein the substance is an expanding agent provided between the inner and outer wall parts of each shells and further wherein said pressure generating step comprises the step of heating the expanding agent for expanding the same.

9. The method of claim 7, wherein said substance is fluid, and said pressure generating step includes injecting the fluid between respective inner and outer wall parts of the two shell.

10. A method of manufacturing an apparatus for muffling sound or catalytic treatment of exhaust and including a casing having an elongate longitudinal wall formed of an outer wall part and an imperforated inner wall part, and two opposite closing walls, said method comprising the steps of:

producing two sheet metal pieces for forming the outer and inner wall parts;

applying a foamable expanding agent to at least one of two surfaces facing each other of the two sheet metal pieces;

placing the two sheet metal pieces one upon another;

bending the two sheet metal pieces to form the longitudinal wall, said bending step including the step of pressing longitudinal end portions of the two wall parts extending along a surface line together and turning them up to form a longitudinal flange;

connecting the two wall parts, at opposite axial ends of the casing, to each other and to respective closing walls;

thereafter, generating a pressure between the outer and inner wall parts by heating the expanding agent for indenting the inner wall part, at least in some places, toward an interior of the casing thereby to produce an intermediate space between the two wall parts; and thereafter, burning the foamed expanding agent at a temperature of at least 300° C.

11. A method of manufacturing an apparatus for muffling sound or catalytic treatment of exhaust and including a casing having an outer wall part and an inner all part spaced from each other at least in some places, and two opposite ends, said method comprising the steps of:

applying a foamable expanding agent between the inner and outer wall parts;

connecting the inner and outer wall parts to each other at least at the two opposite ends of the casing;

generating a pressure between the inner and outer wall parts by heating the expanding agent for indenting the inner wall part toward an interior of the casing, at least in some places, thereby to produce an intermediate space between the two wall parts; and thereafter, burning the foamed expanding agent at a temperature of at least 300° C.

12. A method of manufacturing an apparatus for muffling sound of exhaust, including a casing having an elongated longitudinal wall formed of an outer wall part and an imperforated inner wall part and two closing walls at opposite ends thereof; and an interior which is divided into three regions by two intermediate walls wherein the middle interior region is constructed as a hollow chamber and is connected with the inlet and the outlet of the casing via exhaust pipes which are enveloped in the outer region of the interior by a sound absorbing material;

said method comprising the steps of:

placing two sheet metal pieces for forming the two wall parts, respectively, one upon the other;

bending the two sheet metal pieces to form the longitudinal wall;

inserting the two intermediate walls, the exhaust pipes and the sound absorbing material during or after bending;

placing the two closing walls on the exhaust pipes which partially project out;

connecting the two wall parts to each other and to a closing wall at the two opposite ends of the casing; and generating a pressure between the outer wall part and the inner wall part by a substance for indenting the inner wall part between a closing wall and an intermediate wall and between the two intermediate walls toward an interior of the casing thereby to produce an intermediate space between the inner and outer wall parts.

13. The method of claim 12, wherein the substance is an expanding agent provided between the inner and outer wall parts of each shell and further wherein said pressure generating step comprises the step of heating the expanding agent for expanding the same.

14. The method of claim 12, wherein said substance is fluid, and said pressure generating step includes injecting the fluid between respective inner and outer wall parts.

* * * * *